US011873632B2

(12) United States Patent
Nathamuni

(10) Patent No.: US 11,873,632 B2
(45) Date of Patent: Jan. 16, 2024

(54) URINE CATCHER FOR A URINAL

(71) Applicant: Venkatesh Nathamuni, Los Altos, CA (US)

(72) Inventor: Venkatesh Nathamuni, Los Altos, CA (US)

( * ) Notice: Subject to any disclaimer, the term of this patent is extended or adjusted under 35 U.S.C. 154(b) by 0 days.

(21) Appl. No.: 17/509,042

(22) Filed: Oct. 24, 2021

(65) Prior Publication Data

US 2022/0162845 A1 May 26, 2022

Related U.S. Application Data

(60) Provisional application No. 63/117,376, filed on Nov. 23, 2020.

(51) Int. Cl.
*E03D 13/00* (2006.01)

(52) U.S. Cl.
CPC ..... *E03D 13/005* (2013.01)

(58) Field of Classification Search
CPC ..... E03D 13/005
See application file for complete search history.

(56) References Cited

U.S. PATENT DOCUMENTS

| | | | |
|---|---|---|---|
| 3,193,845 | A | 7/1965 | Funk |
| 3,914,803 | A | 10/1975 | Gregovski |
| 4,060,859 | A | 12/1977 | Anderson |
| 4,133,062 | A | 1/1979 | Fulbright, Jr. |
| 4,348,776 | A | 9/1982 | Sarjeant |
| 5,117,512 | A | 6/1992 | Bressler |
| 5,224,222 | A | 7/1993 | Jones |
| 5,276,925 | A | 1/1994 | Blaha |
| 5,373,589 | A | 12/1994 | Rego |
| 5,564,135 | A | 10/1996 | Jones |
| 5,815,851 | A | 10/1998 | Perry |
| 5,983,410 | A | 11/1999 | Webster |
| 6,357,055 | B1 | 3/2002 | Gambla |
| 6,385,785 | B1 | 5/2002 | Linden |
| 6,978,491 | B1 | 12/2005 | Miller |
| 7,017,198 | B2 | 3/2006 | Conn |
| 7,921,478 | B1 | 4/2011 | Vanini |
| 9,139,995 | B2 | 9/2015 | Escudero |
| 9,918,599 | B1 | 3/2018 | Bensimon |
| 10,337,182 | B1 | 7/2019 | Bender |
| 2004/0237181 | A1 | 12/2004 | Atkins-Williams |
| 2005/0193482 | A1 | 9/2005 | Gambla |

(Continued)

FOREIGN PATENT DOCUMENTS

| | | | |
|---|---|---|---|
| CN | 105064483 A | * | 11/2015 |
| CN | 105064483 B | | 8/2016 |

OTHER PUBLICATIONS

Written Opinion of the International Searching Authority for PCT/US2021/060236; dated Mar. 22, 2022.

*Primary Examiner* — Janie M Loeppke
(74) *Attorney, Agent, or Firm* — Steven R. Vosen

(57) ABSTRACT

A urine catcher as described helps to prevent urine accumulating near the ground of a urinal by providing a urine catcher that moves into place when a person approaches the urinal. In one embodiment, the system is mechanically actuated and moves the urine catcher through a linkage. In another embodiment, the system includes a proximity or motion sensor coupled to a motor which moves the urine catcher. The urine catcher may be provided as a kit for installing adjacent to a urinal.

22 Claims, 8 Drawing Sheets

(56) References Cited

U.S. PATENT DOCUMENTS

| | | | | |
|---|---|---|---|---|
| 2007/0044221 | A1 | 3/2007 | Wise | |
| 2009/0320198 | A1 | 12/2009 | Yefremov | |
| 2013/0061379 | A1 | 3/2013 | Garner | |
| 2018/0163386 | A1* | 6/2018 | Storey | E03D 13/005 |
| 2018/0371736 | A1* | 12/2018 | Lor | E03D 13/00 |
| 2020/0109547 | A1* | 4/2020 | Brown | E03D 13/005 |

* cited by examiner

URINE CATCHER FOR A URINAL

CROSS-REFERENCE TO RELATED APPLICATIONS

This application claims the benefit of U.S. Provisional Application No. 63/117,376, filed Nov. 23, 2020, the contents of which are hereby incorporated by reference in its entirety.

BACKGROUND OF THE INVENTION

Field of the Invention

This invention relates, generally, to urinals, and more specifically to a urine catcher for diverting urine into a urinal.

Discussion of the Background

The areas around urinals and men's toilets often have significant amounts of urine on the surrounding areas due to urine that misses the urinal or toilet bowl. Thus, it is not uncommon for such areas to include significant urine spills on the floors and urine stains on the rims and adjacent walls. This can result in sticky/slippery/dirty surfaces and the resulting foul odor, and creates a very messy environment that requires frequent cleaning. It also creates an unpleasant experience for not only the person urinating, but also for janitors cleaning the toilet. Additionally, the messy environment could cause health hazards and potentially spread infection.

There is a need in the art for a urine catcher for a urinal to reduce the amount of urine that collects around urinals. Such a urine catcher should be compatible for attachment to standard urinals.

BRIEF SUMMARY OF THE INVENTION

The present invention overcomes the disadvantages of prior art urinals with a urinal having a urine catcher for a urinal that increases size of the rim for accepting urine.

Certain embodiments provide a urine catcher that is user-actuated to rise up around the rim or periphery of the urinal/toilet when a person approaches the urinal/toilet to urinate, and thus reduce the likelihood of urine spraying on to the floor or the adjacent walls.

Certain other embodiments provide a user-actuated urine catcher that is mechanically actuated when the user steps on a pedal connected to the urine catcher by a linkage.

Yet other embodiments provide a urine catcher system for a urinal whose movement is affected by a proximity sensor and a motor.

Certain embodiments provide an apparatus for mounting adjacent to the bowl of a urinal, where the apparatus directs a flow of urine from a user into the bowl. The apparatus includes a urine catcher located above the bowl of the urinal, where the urine catcher includes a surface shaped to direct a flow of urine, and a user-actuated mechanism coupled to and adapted to move the urine catcher. When the user actuates the user-actuated mechanism, a portion of the urine catcher moves away from the bowl and towards the user, such that urine from the user that is directed into urine catcher flows into the bowl of the urinal.

Certain other embodiments provide a kit for mounting adjacent to a urinal having a bowl. The kit includes a urine catcher including a surface shaped to direct a flow of urine, and a user-actuated mechanism, where at least one of the urine catcher and user-actuated mechanism are adapted for attaching on or adjacent to the urinal. When the urine catcher and user-actuated mechanism are mounted adjacent to a urinal with the surface above the bowl, and when user actuates the user-actuated mechanism, a portion of the urine catcher moves away from the bowl and towards the user, such that urine from the user is directed into urine catcher flows into the bowl of the urinal.

These features together with the various ancillary provisions and features which will become apparent to those skilled in the art from the following detailed description, are attained by the urine catcher system of the present invention, preferred embodiments thereof being shown with reference to the accompanying drawings, by way of example only, wherein:

Reference symbols in the Figures indicate certain components, aspects or features shown therein, with reference symbols common to more than one Figure indicating like components, aspects or features shown therein.

DETAILED DESCRIPTION OF THE INVENTION

Figure 1A:
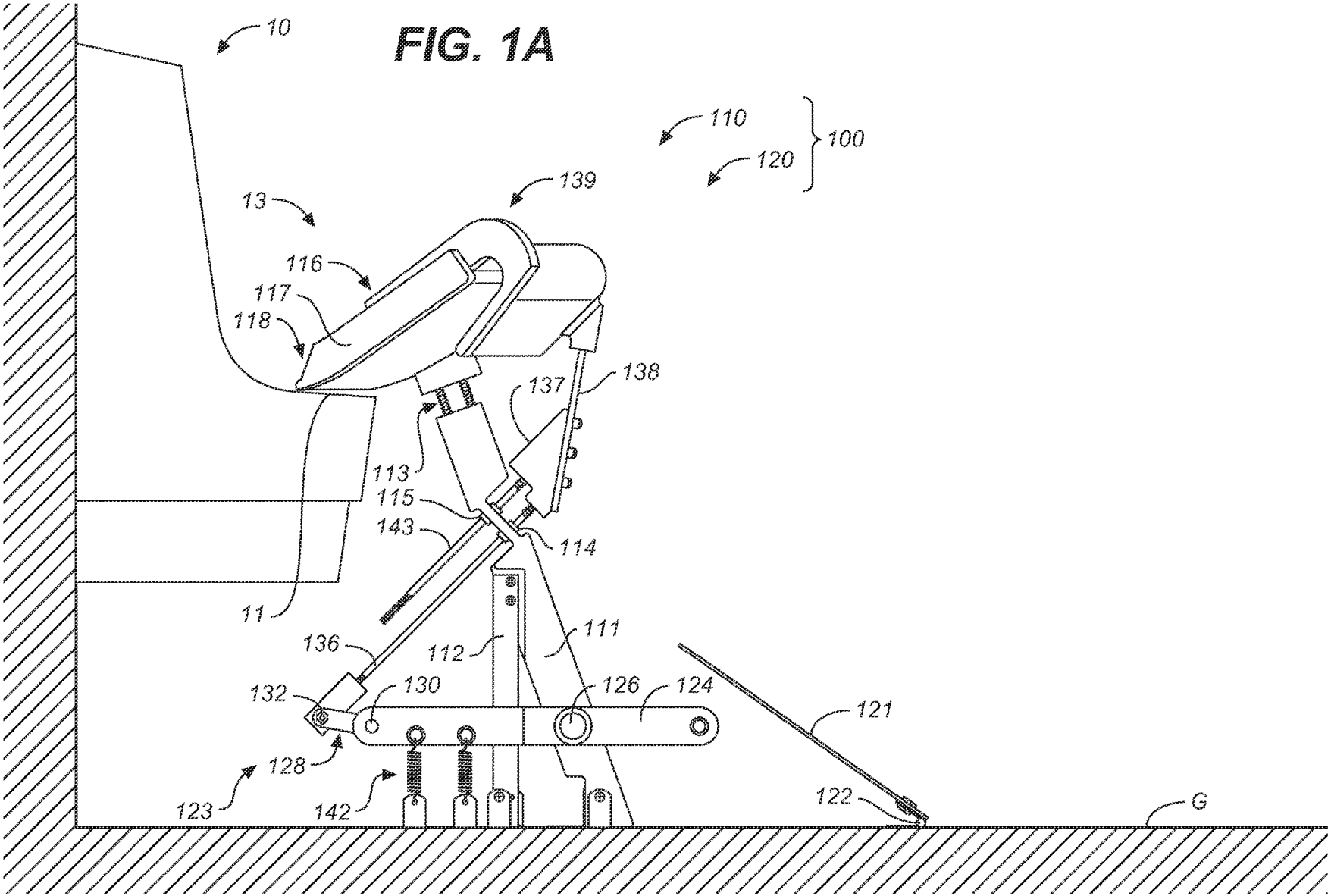
FIG. 1A is a side view of a first embodiment urine catcher in a retracted position as mounted near a urinal.
Figure 1B:
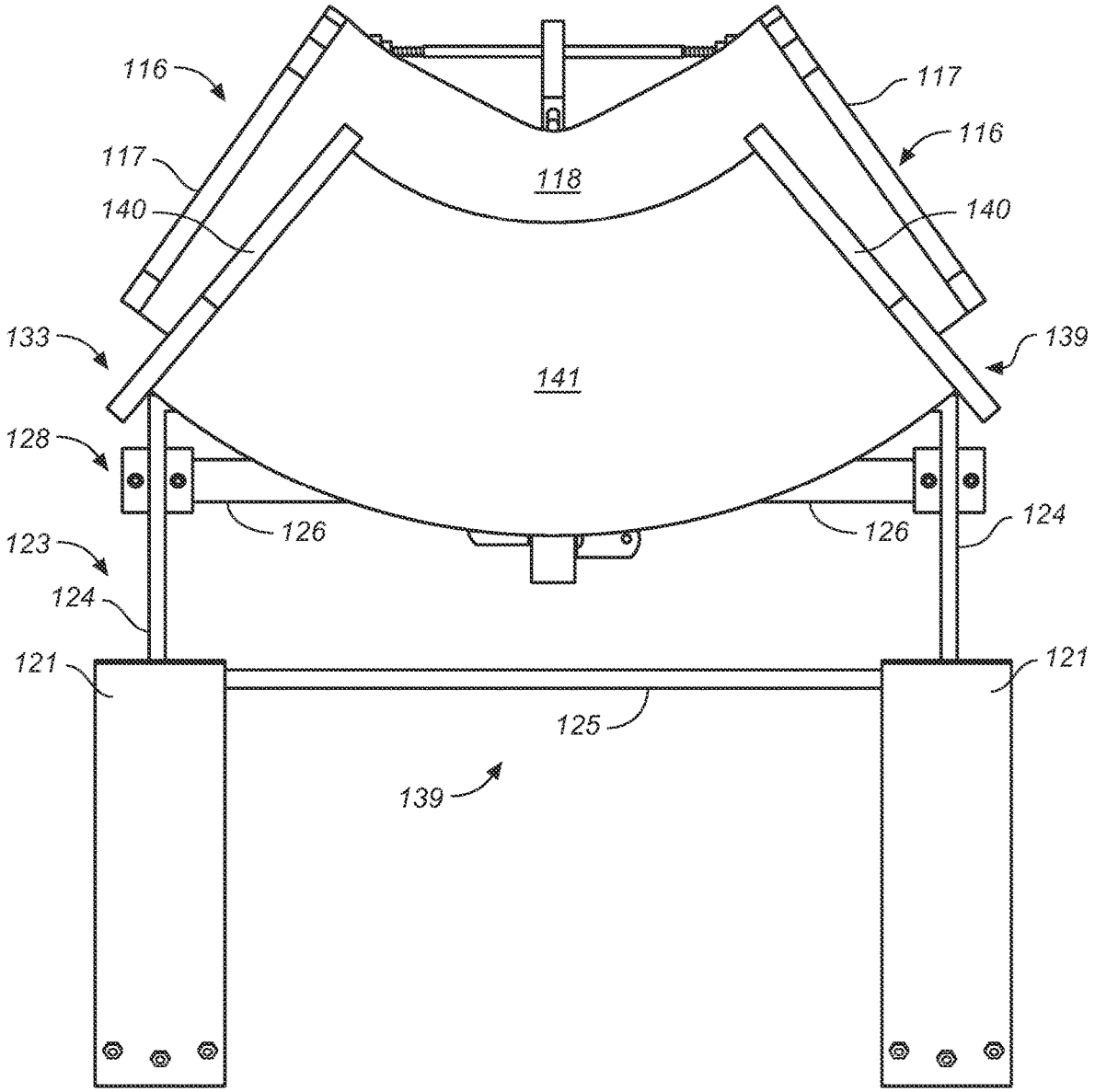
FIG. 1B is a top view of the embodiment of FIG. 1A as mounted, without showing the urinal.
Figure 2:
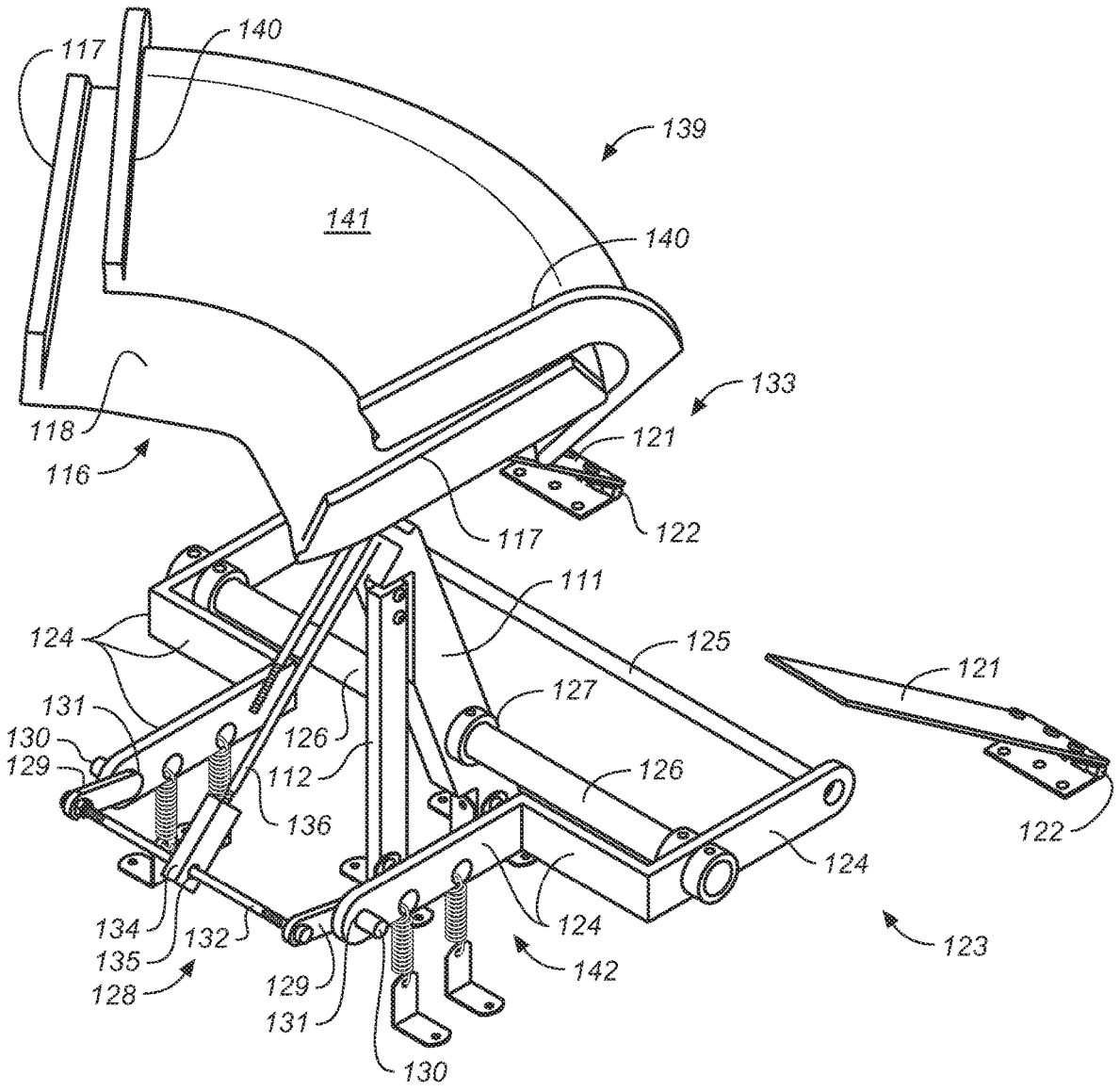
FIG. 2 is a top rear perspective view of the embodiment of FIG. 1A as mounted, without showing the urinal.

FIGS. 1A, 1B, and 2 are a side view, a top view, and a top rear perspective view of a first embodiment urine catcher 100 in a retracted position as it is mounted on the ground G adjacent to a urinal 10. FIG. 1A illustrates the urine catcher 100 as mounted near urinal 10, and FIGS. 1B and 2 illustrate the mounted urine catcher without showing the urinal. Urinal 10 may be, for example a standard, prior art urinal attached to plumbing and includes a flushing mechanism, as is known in the art, and has a rim 11 surrounding a bowl 13.

Urine catcher 100 includes a fixed portion 110 that is fixed relative to urinal 10 and a movable portion 120 having components that move relative to the urinal. In certain embodiments, movable portion 120 is user-actuated by a mechanical mechanism, in which the movable portion moves when a user presses a lever or pedal. In certain other embodiments, movable portion 120 is user-actuated by electronics, in which the movable portion moves when a motor receives a signal from a sensor indicating the presence of a user.

As discussed herein, urine catcher 100 includes a first, fixed catcher portion 116 that is positioned above urinal bowl 13 and a second, movable catcher portion 139 that is positioned above the fixed catcher portion. Upon actuating one of a pair of foot pedals 121, the movable catcher portion 139 moves away from urinal 10, and urine directed into movable catcher 139 flows though the fixed catcher portion 116 and into urine bowl 13.

Fixed portion 110 includes a first fixed portion 111 and a second fixed portion 112 that are both attached to each other and to ground G. First fixed portion 111 extends to threaded rods 113 which support fixed catcher portion 116 having a fixed bowl 118 with a rim 117 and includes an aperture 127, as shown in FIG. 2. Threaded rods 113 allow for the position of fixed urine catcher 113 to be adjusted so that it is positioned above bowl 13. First fixed portion 111 also includes through holes 114 and 115 for stabilizing and/or directing parts of moving portion 120, as described subsequently.

Moving portion 120 includes a linkage formed from a first link 123, a second link 128 and a third link 130, which are best shown in FIG. 2. First link 123 includes a pair of side portions 124 connected by a first bar 125 and a second bar 126, where the pair of side portions are attached to ground G by springs 142. Each of the pair of side portions 124 includes one of a pair of apertures 131 for connecting to the second link 128, as described subsequently. Second bar 126 passes through aperture 127 of first fixed portion 111 permitting first link 123 to rotate relative to fixed portion 110.

Second link 128 includes a pair of bars 129 each having one of a pair of pins 130 which extends through one of the pair of apertures 131, and which are joined by third bar 132. Second link 128 thus rotates relative to first link 123 about the pair of pins 130.

Third link 133 includes, sequentially, an end portion 134 having an aperture 135, a first rod 136 attached to the end portion, a first portion 137 attached to the first rod, a support 138 attached to the first portion, and movable catcher portion 139. Movable catcher 139 includes a moving bowl 141 having sides 140, and which is sized to fit within fixed urine catcher 116. Third link 133 includes a second rod 143 attached to first portion 137. First rod 136 passes through hole 114 and second rod 142 passes through hole 115, directing the motion and/or providing stability to moving portion 120.

Moving portion 120 also includes the pair of foot pedals 121 which are each attached to ground G by one of a pair of hinges 122. The urine catcher 100 is actuated by pressing on one or more foot pedals 121, as discussed subsequently.

Figure 3A:
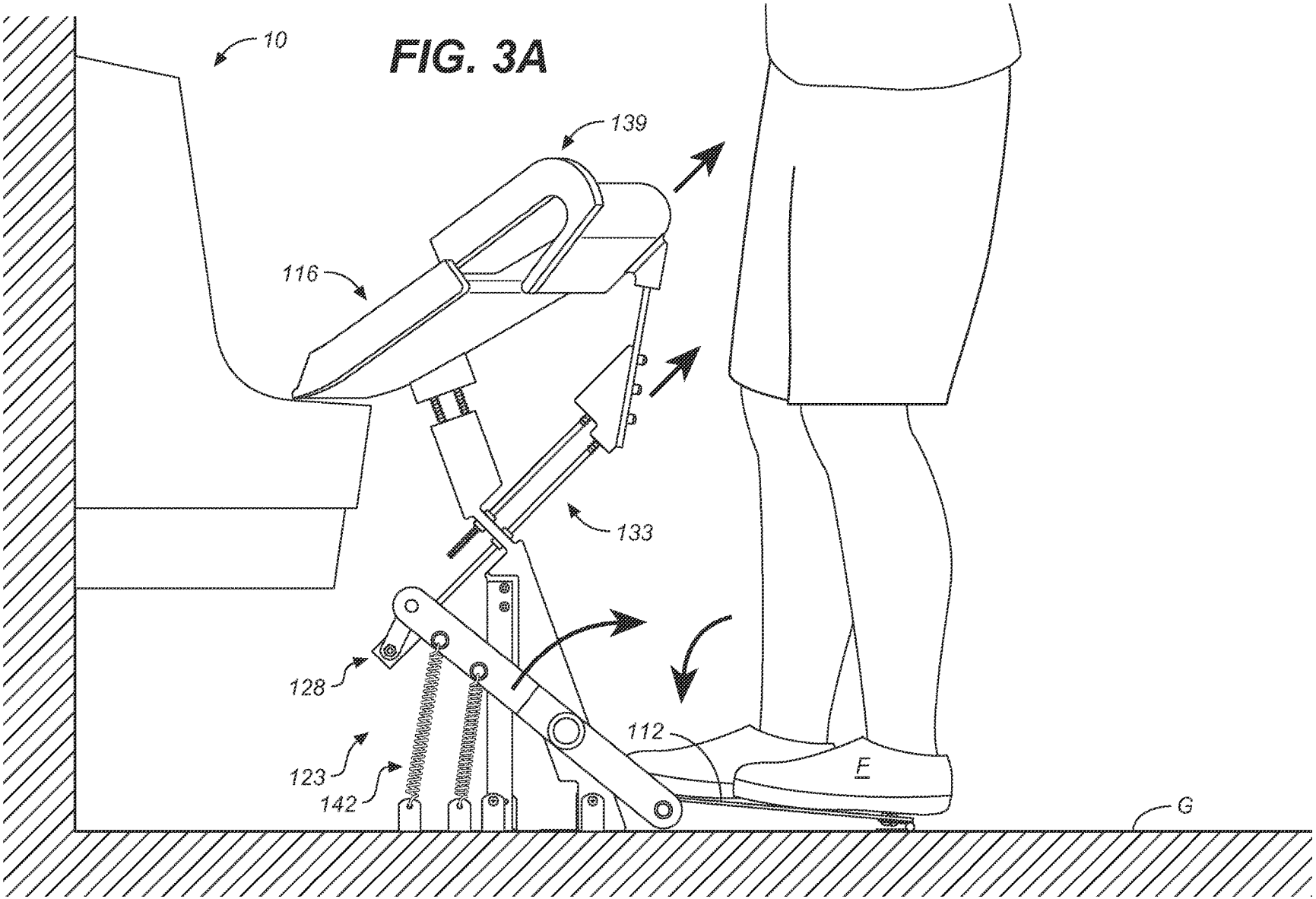
FIG. 3A is a side view of the first embodiment urine catcher mounted near a urinal in an extended position when actuated by stepping on one or more foot pedals.
Figure 3B:
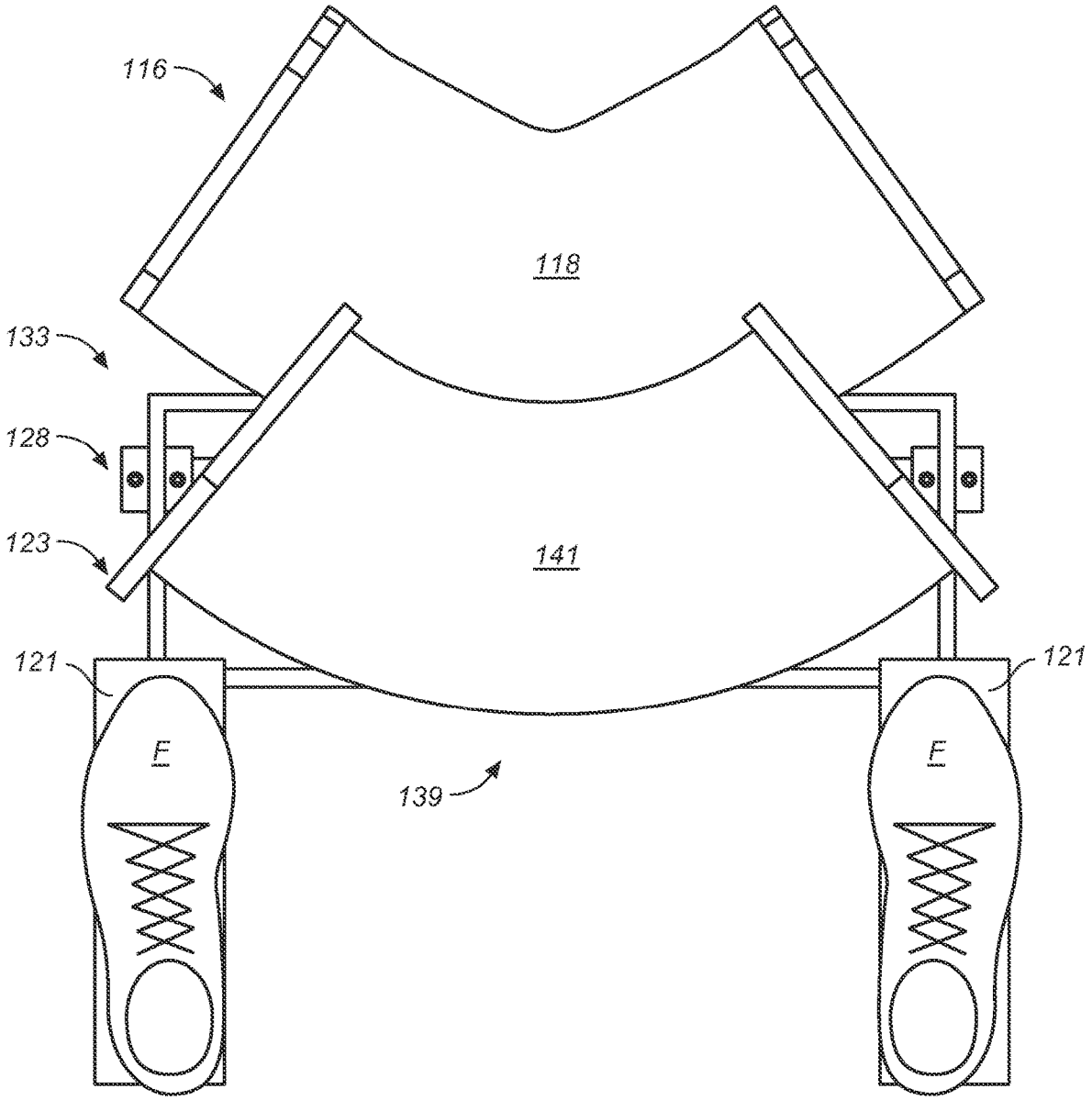
FIG. 3B is a top view corresponding to FIG. 3A as mounted, without showing the urinal.

FIGS. 3A and 3B are a side view and a top view, respectively of urine catcher 100 in an extended position as actuated by stepping on one or more foot pedals 121, where FIG. 3B shows the urine catcher without showing the urinal;

As illustrated in FIGS. 3A and 3B, when a user steps on one or both pedals 121 with their feet F, first link 123, second link 128, and third link 133 respond by moving movable catcher 139 towards the user. Thus, when a foot pedal 121 contacts first bar 125, first link 123 rotates about second bar 126 causing second link to rotate about pins 130, and third link to move linearly towards the user stepping on the foot pedals.

As is best shown in FIG. 3B, the bowl area has increased due to the movement of movable catcher 139, and importantly the movable bowl 141 moves towards the user, thus minimizing any spray which may occur when the user urinates.

When the user removes their feet F from foot pedals 121, the tension in springs 142 causes movable catcher 139 to move back to the position shown in FIGS. 1A, 1B, and 2.

Alternative Embodiments

Figure 4A:
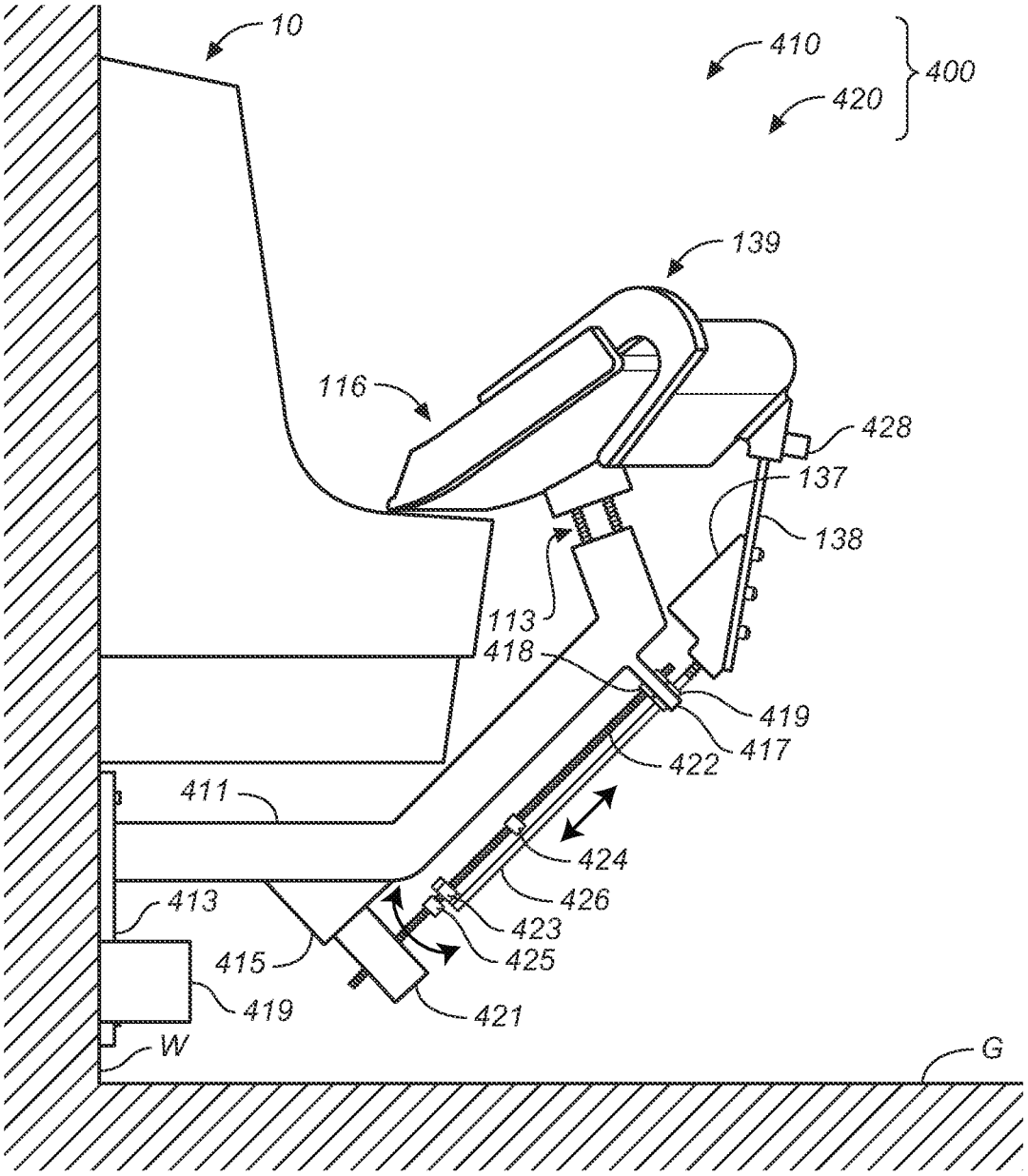
FIGS. 4A and 4B are a side view and front view, respectively, of a second embodiment urine catcher mounted near a urinal and in a retracted position.
Figure 4B:
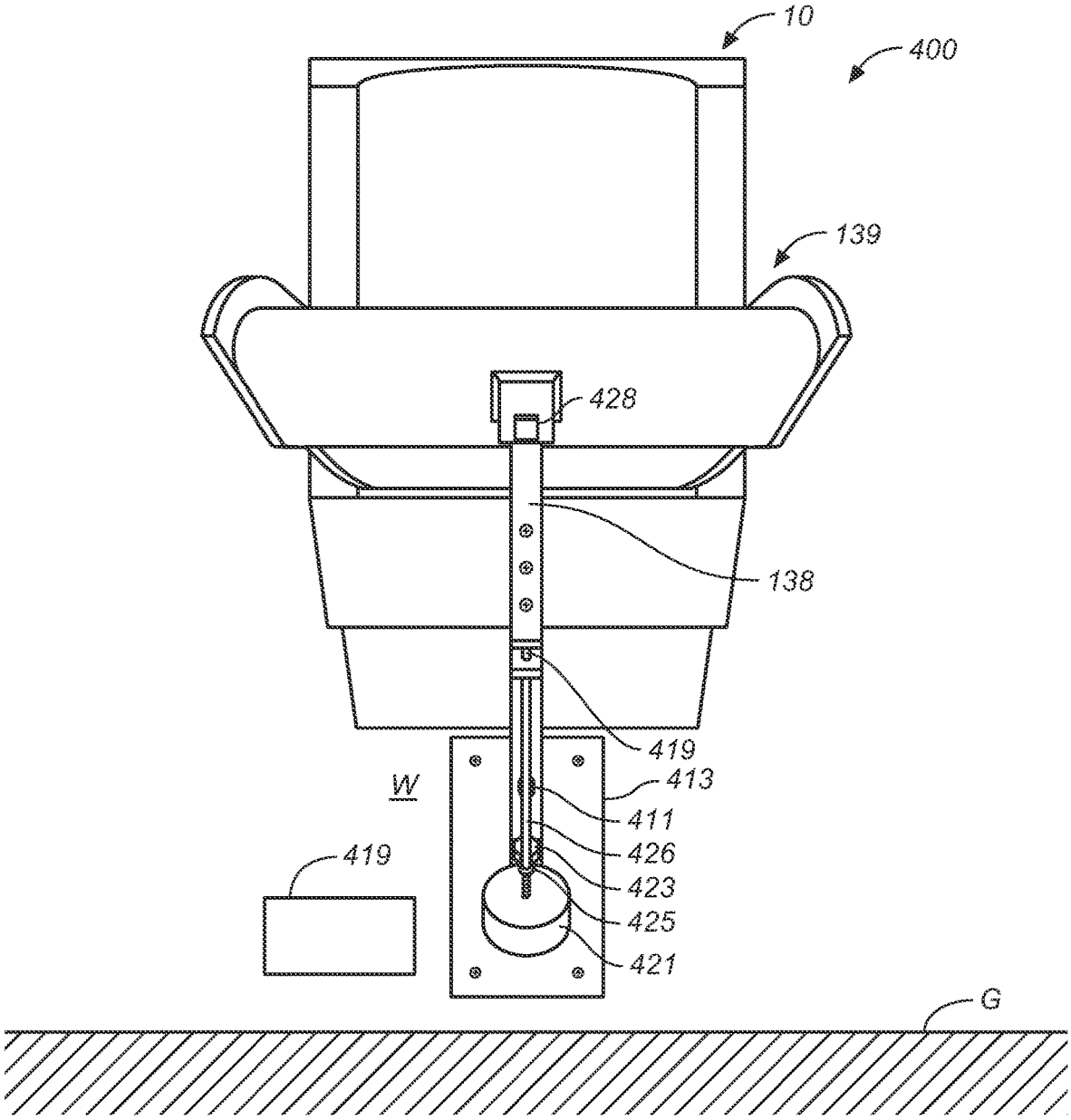

FIGS. 4A and 4B are a side view and front view, respectively, of a second embodiment urine catcher 400 mounted near urinal in a retracted position. Urine catcher 400 includes a fixed portion 410 that is fixed relative to urinal 10 and a movable portion 420 having components that move relative to the urinal. Urine catcher 400 is generally similar to urine catcher 100, fixed portion 410 is generally similar to fixed portion 110, and movable portion 420 is generally similar to movable portion 120, except as explicitly stated.

Fixed portion 410 includes a support 411 having a mounting plate 413 for attaching to a wall W adjacent to urinal 10. Support 411 extends away from wall W and includes a motor support 415, and a flange 417, and extends to threaded rods 113 which supports fixed catcher portion 116 as discussed above for the first urine catcher embodiment. Flange 417 includes through holes 418 and 419, and which may also include bushings, for supporting portions of movable portion 420, as described subsequently.

Movable portion 420 includes a threaded rod 422 that extends from motor 421 to hole 418, and which supports a first limit switch 424 and second limit switch 425, and a nut 423 threaded onto the threaded rod. Movable portion 420 also includes a rod 426 that is attached to, and extends from, a side of nut 423 to first portion 137, and is supported by fixed portion 410 by passing through hole 417.

Nut 423 is thus fixed to rod 426 and moves along threaded rod 422 according to the rotation of the threaded rod. Specifically, the rotation of threaded rod 422 by motor 421 causes nut 423 and rod 426 to move away or towards motor 421, depending on the direction of rotation of the motor, as indicated by the arrows on FIG. 4A.

Urine catcher 400 also includes a controller 419 that is programmed to accepts signals from sensor 428, the first limit switch 424 and the second limit switch 425 and operate motor 422. The operation of urine catcher 400 is user-actuated when a user is near urinal 10, as determined by sensor 428. Controller 419 and sensor 428 may be attached to either fixed portion 410, movable portion 420, or may be attached to urinal 10, wall W or ground G.

In operation, when sensor 428 senses the proximity of a user and when movable urine catcher 139 is not in an extended position, such as is shown in FIG. 4, controller 419 sends a signal to motor 421 which causes movable urine catcher 139 to move away from urinal 10 and towards the user, similar to the motion of the urine catcher 100. Specifically, controller 419 causes motor 421 to rotate threaded rod 422 according to signals from sensor 428 and limit switches 424 and 425. When nut 423 contacts first limit switch 424, the movable urine catcher is fully extended and controller 419 causes motor 421 to stop the rotation of threaded rod 422.

When sensor 428 does not detect the presence of a person near urinal 10, motor 421 rotates nut 423 and thus rod 426 towards urinal 10 as shown in FIG. 4. Specifically, when sensor 428 senses a lack of proximity of a user and when movable urine catcher 139 is not in a retracted position, as shown in FIG. 4, controller 419 sends a signal to motor 421 which causes movable catcher to retract towards urinal 10. When nut 423 contacts second limit switch 425, the movable urine catcher is fully retracted and controller 419 causes motor 421 to stop the rotation of threaded rod 422.

Figure 5:
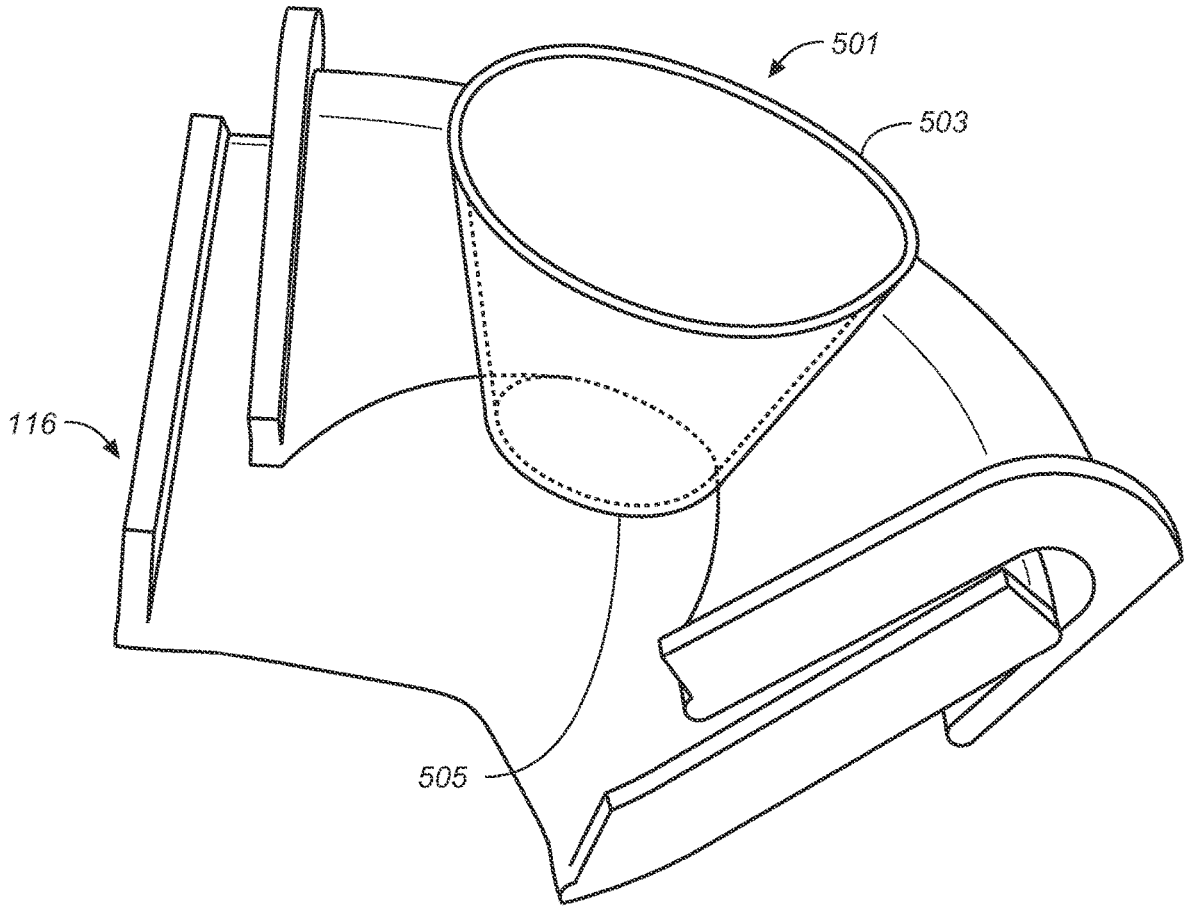
FIG. 5 is a perspective view of a second embodiment movable catcher.

FIG. 5 is a perspective view of a second embodiment movable catcher 501, which is in the shape of an open-bottomed bowl with a rim 503 and an opening 505 located on movable catcher portion 139. Movable catcher 501 is shaped to direct a urine stream provided within rim 503 in to fixed bowl 118, and into urinal bowl 13.

In another alternative embodiment, the apparatus does not include a fixed urine catcher, such as fixed catcher portion 116, and only has movable urine catcher, similar to movable catcher portion 139.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

It should further be appreciated that various alternative designs are within the scope of the present invention. Thus, for example and without limitation, the scope of the present invention includes: 1) other linkages or motor driven mechanisms for moving the urine catcher, 2) the use of only one foot pedal; 3) other shaped urine catchers which direct the urine into the urinal bowl. In addition, the components described herein as being part of the urine catcher may be packaged as a kit which provides a urine catcher to a urinal.

I claim:

1. An apparatus for mounting adjacent to a bowl of a urinal, where the apparatus directs a flow of urine from a user into the bowl, said apparatus comprising:

a urine catcher located above the bowl of the urinal, where the urine catcher includes a surface shaped to direct a flow of urine, where the urine catcher includes a first urine catcher including a first surface and a second urine catcher including a second surface at a fixed position, where the second surface is below the first surface, and where the second urine catcher is between the first urine catcher and the bowl, and a user-actuated mechanism coupled to and adapted to move the urine catcher, where, when the user actuates the user-actuated mechanism, the first urine catcher moves linearly away from the bowl and towards the user, such that urine from the user directed into the first urine catcher flows into the second urine catcher, and into the bowl of the urinal.

2. The apparatus of claim 1, where the first surface includes a curved portion.

3. The apparatus of claim 1, where the first surface includes a first rim extending upwards.

4. The apparatus of claim 1, where the first surface includes a portion in the shape of an open-bottom bowl.

5. The apparatus of claim 1, where the second surface includes a curved portion.

6. The apparatus of claim 1, where the second surface includes a second rim extending upwards from the bowl.

7. The apparatus of claim 1, where the user-actuated mechanism includes a mechanical actuator.

8. The apparatus of claim 7, where the user-actuated mechanism includes a linkage between the mechanical actuator and the urine catcher.

9. The apparatus of claim 7, where the mechanical actuator includes a foot pedal located in front of the urinal.

10. The apparatus of claim 1, where the user-actuated mechanism includes a sensor and a motor coupled to the sensor and the urine catcher, where the user-actuated mechanism is activated when the sensor determines a proximity of the user.

11. The apparatus of claim 10 where the sensor is a motion sensor or a proximity sensor.

12. The apparatus of claim 10, where the motor is a stepper motor.

13. A kit for mounting adjacent to a urinal having a bowl, said kit comprising:

a urine catcher including a first urine catcher having a first surface and a second urine catcher having a second surface, where the second surface is below the first surface, and a user-actuated mechanism, where at least one of the urine catcher and user-actuated mechanism are adapted for attaching on or adjacent to the urinal, such that, when the urine catcher and user-actuated mechanism are mounted adjacent to the urinal with the second surface at a fixed position and with the first surface and the second surface above the bowl, and when user actuates the user-actuated mechanism, the first surface of the first urine catcher moves linearly away from the bowl and towards the user, such that urine from the user directed into the first urine catcher flows into the second urine catcher, and into the bowl of the urinal.

14. The kit of claim 13, where the first surface or the second surface includes a curved portion.

15. The kit of claim 13, where the first surface or the second surface includes a rim extending upwards from the bowl.

16. The kit of claim 13, where the first surface includes a portion in the shape of an open-bottom bowl.

17. The kit of claim 13, where the user-actuated mechanism includes a foot pedal and a linkage between the foot pedal and the urine catcher.

18. The kit of claim 13, where the user-actuated mechanism includes a sensor and a motor coupled to the sensor and the urine catcher, where the user-actuated mechanism is activated when the sensor determines a proximity of the user.

19. The kit of claim 18, where the sensor is a motion sensor or a proximity sensor.

20. The kit of claim 18, where the motor is a stepper motor.

21. The kit of claim 13, where the urine catcher is adapted for mounting on the ground near the urinal.

22. The kit of claim 13, where the urine catcher is adapted for mounting on a wall adjacent to the urinal.

* * * * *